US010344664B2

(12) United States Patent
Murai et al.

(10) Patent No.: US 10,344,664 B2
(45) Date of Patent: Jul. 9, 2019

(54) CONTROL DEVICE AND METHOD FOR COOLING SYSTEM

(71) Applicant: Hitachi Automotive Systems, Ltd., Hitachinaka-shi, Ibaraki (JP)

(72) Inventors: Atsushi Murai, Isesaki (JP); Shigeyuki Sakaguchi, Isesaki (JP); Yuichi Toyama, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 61 days.

(21) Appl. No.: 15/508,199

(22) PCT Filed: Sep. 16, 2015

(86) PCT No.: PCT/JP2015/076332

§ 371 (c)(1),
(2) Date: Mar. 2, 2017

(87) PCT Pub. No.: WO2016/043229

PCT Pub. Date: Mar. 24, 2016

(65) Prior Publication Data

US 2017/0254255 A1 Sep. 7, 2017

(30) Foreign Application Priority Data

Sep. 18, 2014 (JP) ..... 2014-190143

(51) Int. Cl.
*F01P 3/20* (2006.01)
*F01P 5/12* (2006.01)
(Continued)

(52) U.S. Cl.
CPC *F01P 7/16* (2013.01); *F01P 3/20* (2013.01); *F01P 5/12* (2013.01); *F01P 7/165* (2013.01);
(Continued)

(58) Field of Classification Search
CPC ..... F01P 7/16; F01P 3/20; F01P 5/12; F01P 11/16; F01P 7/165; F01P 2023/08; F01P 2007/146
See application file for complete search history.

(56) References Cited

U.S. PATENT DOCUMENTS

2013/0255603 A1* 10/2013 Pursifull ..... F01P 11/16 123/41.15
2013/0255605 A1* 10/2013 Jentz ..... F01P 11/16 123/41.15
2017/0204774 A1* 7/2017 Gonze ..... F01P 3/20

FOREIGN PATENT DOCUMENTS

JP 2006-214279 A 8/2006
JP 2010-43555 A 2/2010
(Continued)

OTHER PUBLICATIONS

Machine Translation of JP-2014-001646 retrieved from Espacenet on Aug. 28, 2018. (Year: 2018).*
(Continued)

*Primary Examiner* — Thomas Ingram
(74) *Attorney, Agent, or Firm* — Crowell & Moring LLP

(57) ABSTRACT

A cooling system of an internal combustion engine includes a flow channel switching valve for sequentially switching between a plurality of cooling water passages so as to distribute cooling water to at least one cooling water passage. When a control device for the cooling system switches between the cooling water passages by controlling the flow channel switching valve in accordance with the progress of warm-up of the internal combustion engine, the control device suppresses the distribution rate of the cooling water to the cooling water passage to which the distribution of the cooling water is just started.

9 Claims, 18 Drawing Sheets

(51) Int. Cl.
*F01P 7/14* (2006.01)
*F01P 7/16* (2006.01)
*F01P 11/16* (2006.01)

(52) U.S. Cl.
CPC ..... *F01P 11/16* (2013.01); *F01P 2007/146* (2013.01); *F01P 2023/08* (2013.01)

(56) References Cited

FOREIGN PATENT DOCUMENTS

| | | | |
|---|---|---|---|
| JP | 2012-172608 | A | 9/2012 |
| JP | 2014-1646 | A | 1/2014 |
| WO | WO 2013/168524 | A1 | 11/2013 |

OTHER PUBLICATIONS

Machine Translation of JP-2010-043555 retrieved from Espacenet on Aug. 28, 2018 (Year: 2018).*

International Preliminary Report on Patentability (PCT/IB/338 & PCT/IPEA/409) issued in PCT Application No. PCT/JP2015/076332 dated Mar. 23, 2017, including English translation of document C2 (Japanese-language Written Opinion (PCT/ISA/237)) previously filed on Mar. 2, 2017 (6 pages).

Japanese-language Office Action issued in counterpart Japanese Application No. 2014-190143 dated Jan. 23, 2018 with partial English translation (5 pages).

International Search Report (PCT/ISA/210) issued in PCT Application No. PCT/JP2015/076332 dated Dec. 22, 2015 with English translation (3 pages).

Japanese-language Written Opinion (PCT/ISA/237) issued in PCT Application No. PCT/JP2015/076332 dated Dec. 22, 2015 (4 pages).

Japanese-language Office Action issued in counterpart Japanese Application No. 2014-190143 dated Sep. 4, 2018 with partial English translation (six (6) pages).

Japanese-language Office Action issued in counterpart Japanese Application No. 2014-190143 dated Dec. 27, 2018 with English translation (six (6) pages).

* cited by examiner

CONTROL DEVICE AND METHOD FOR COOLING SYSTEM

TECHNICAL FIELD

The present invention relates to a control device and method for a cooling system of an internal combustion engine.

BACKGROUND ART

JP 2006-214279 A (Patent Document 1) discloses a technique to accelerate the warm-up of an internal combustion engine. In this technique, when the cooling water starts to flow through both the cooling water passage in the engine main body and the radiator, the cooling water is intermittently supplied to flow through the cooling water passage in the engine main body.

REFERENCE DOCUMENT LIST

Patent Document

Patent Document 1: JP 2006-214279 A

SUMMARY OF THE INVENTION

Problems to be Solved by the Invention

However, even intermittently supplying the cooling water to flow through the cooling water passage in the engine main body just after the switching of the flow channels for the cooling water does still not prevent the low-temperature cooling water in the radiator from entering the engine main body, and thus still allows a temporal drop in the cooling water temperature in the engine main body. Such a temporal drop in the cooling water temperature in the engine main body slows down the warm up of the internal combustion engine, thus deteriorating fuel economy, exhaust gas properties (emissions) and the like of the internal combustion engine, for example. In addition, in such a technique, the temperature of conditioned air provided by air heating device also temporarily drops just after the flow channels for the cooling water are switched so as to supply the cooling water to the heater core, which might possibly make occupants in the vehicle feel uncomfortable, for example.

In view of the above, the present invention has been made to provide a control device and method for a cooling system of an internal combustion engine which is capable of preventing a temporal drop in the temperature of cooling water during the warm-up of the internal combustion engine.

Means for Solving the Problems

To this end, a control device for a cooling system of an internal combustion engine controls a flow channel switching valve for switching between a plurality of cooling water passages to sequentially change at least one of the cooling water passages to which cooling water is distributed in accordance with progress of warm-up of the internal combustion engine. When switching between the cooling water passages, the control device gradually increases, over a predetermined time to a target value, a distribution rate of the cooling water to the cooling water passage to which the distribution of the cooling water is just started, and temporarily stops increasing the distribution rate of the cooling water to the cooling water passage during process of gradually increasing the distribution rate of the cooling water to the cooling water passage.

Effects of the Invention

The present invention allows curbing a temporal drop in the cooling water temperature during the warm-up of the internal combustion engine.

MODE FOR CARRYING OUT THE INVENTION

An embodiment for implementing the present invention will be described in detail below with reference to the accompanying drawings.

Figure 1:
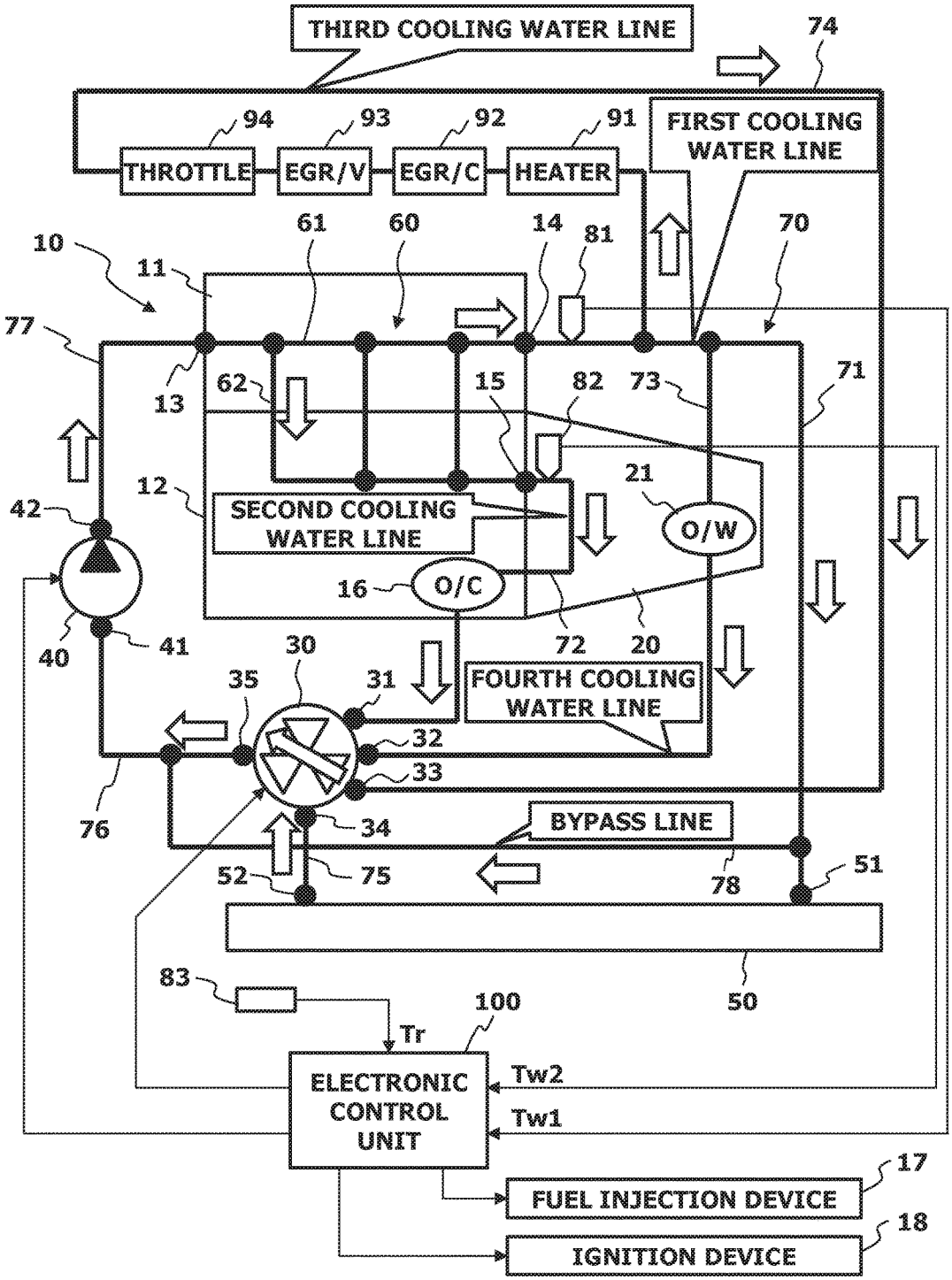
FIG. 1 is a schematic view of an example of a cooling system of an internal combustion engine.

FIG. 1 illustrates an example of a cooling system of an internal combustion engine.

An internal combustion engine 10, which is installed in a vehicle, has a cylinder head 11 and a cylinder block 12. A transmission 20 such as a continuously variable transmission (CVT), an example of a power transmission device, is coupled to the output shaft of internal combustion engine 10. The output of transmission 20 is transmitted to unillustrated drive wheels, thereby making the vehicle travel.

Internal combustion engine 10 is cooled by a water-cooled cooling system which circulates cooling water. The cooling system includes a flow channel switching valve 30 actuated by an electric actuator, an electric water pump (ELWP) 40 driven by an electric motor, a radiator 50, a cooling water passage 60 formed in internal combustion engine 10, and multiple pipes 70 connecting these components.

In internal combustion engine 10, a head cooling water passage 61 is formed as part of cooling water passage 60. Head cooling water passage 61 extends in cylinder head 11 so as to connect a cooling water inlet 13 to a cooling water outlet 14. Cooling water inlet 13 is provided to cylinder head 11 at one end in the cylinder arrangement direction, and cooling water outlet 14 is provided to cylinder head 11 at the other end in the cylinder arrangement direction. In addition, in internal combustion engine 10, a block cooling water passage 62 is formed as part of cooling water passage 60. Block cooling water passage 62 branches off from head cooling water passage 61 and enters cylinder block 12 so as to extend through the interior of cylinder block 12 and to be connected to a cooling water outlet 15 formed in cylinder block 12. Cooling water outlet 15 of cylinder block 12 is formed at the other end in the cylinder arrangement direction, which is on the same side where cooling water outlet 14 of cylinder head 11 is formed.

Thus, the cooling water supplied to cooling water inlet 13 of cylinder head 11 flows through head cooling water passage 61 while cooling cylinder head 11, and is then discharged from cooling water outlet 14 which is formed at the other end of cylinder head 11. To cool cylinder block 12, the cooling water supplied to cooling water inlet 13 of cylinder head 11 flows into block cooling water passage 62 which branches off from head cooling water passage 61, and then flows through block cooling water passage 62 while cooling cylinder block 12. Then, the cooling water is discharged from cooling water outlet 15 which is formed at the other end of cylinder block 12.

To cooling water outlet 14 of cylinder head 11, one end of a first cooling water pipe 71 is connected. The other end of first cooling water pipe 71 is connected to a cooling water inlet 51 of radiator 50.

To cooling water outlet 15 of cylinder block 12, one end of a second cooling water pipe 72 is connected. The other end of second cooling water pipe 72 is connected to a first inlet port 31 among four inlet ports, i.e., first to fourth inlet ports 31 to 34 of flow channel switching valve 30. In the middle of second cooling water pipe 72, there is provided an oil cooler 16 which cools lubricant oil for internal combustion engine 10. Oil cooler 16 exchanges heat between the cooling water flowing through second cooling water pipe 72 and the lubricant oil for internal combustion engine 10.

A third cooling water pipe 73 is connected at one end to the middle of first cooling water pipe 71 and at the other end to second inlet port 32 of flow channel switching valve 30. In the middle of third cooling water pipe 73, there is provided an oil warmer 21 for heating hydraulic oil of transmission 20. Oil warmer 21 exchanges heat between the cooling water flowing through third cooling water pipe 73 and the hydraulic oil of transmission 20. In short, third cooling water pipe 73 allows the cooling water having passed through cylinder head 11 to be partially diverted and introduced into oil warmer 21 which exchanges heat between the cooling water and the hydraulic oil to increase the temperature of the hydraulic oil.

A fourth cooling water pipe 74 is connected at one end to the middle of first cooling water pipe 71, and at the other end to third inlet port 33 of flow channel switching valve 30. On fourth cooling water pipe 74, a heater core 91 for heating air in the vehicle, a water-cooled exhaust gas recirculation (EGR) cooler 92, an EGR control valve 93, and a throttle valve 94 are disposed in this order in the flow direction of the cooling water. EGR cooler 92 and EGR control valve 93 constitute an exhaust gas recirculation device. Throttle valve 94 regulates the amount of air intake in internal combustion engine 10.

Heater core 91 exchanges heat between air for air conditioning and the cooling water flowing through fourth cooling water pipe 74, thus heating the air for air conditioning so as to provide an air heating function. EGR cooler 92 exchanges heat between the cooling water flowing through fourth cooling water pipe 74 and the exhaust gas recirculated into an intake system of internal combustion engine 10 by the exhaust gas recirculation device, thus lowering the temperature of the exhaust gas so as to curb generation of nitrogen oxides during combustion. The temperatures of EGR control valve 93 and throttle valve 94 are increased by exchanging heat with the cooling water flowing through fourth cooling water pipe 74, thus preventing the freeze of moisture in the exhaust gas or in the intake air. As described above, fourth cooling water pipe 74 allows the cooling water having passed through cylinder head 11 to be partially diverted and introduced into heater core 91, EGR cooler 92, EGR control valve 93 and throttle valve 94 so as to exchange heat therewith.

A fifth cooling water pipe 75 is connected at one end to a cooling water outlet 52 of radiator 50, and at the other end to fourth inlet port 34 of flow channel switching valve 30.

A sixth cooling water pipe 76 is connected at one end to an outlet port 35 of flow channel switching valve 30, and at the other end to an intake port 41 of water pump 40. A seventh cooling water pipe 77 is connected at one end to a discharge port 42 of water pump 40, and at the other end to cooling water inlet 13 of cylinder head 11.

An eighth cooling water pipe 78 is connected at one end to the middle of first cooling water pipe 71, and at the other end to the middle of sixth cooling water pipe 76. Specifically, in first cooling water pipe 71, the point connected to eighth cooling water pipe 78 is located downstream to the point connected to third cooling water pipe 73 and downstream to the point connected to fourth cooling water pipe 74.

As described above, flow channel switching valve 30 includes four inlet ports 31 to 34 and one outlet port 35. Second to fifth cooling water pipes 72 to 75 are respectively connected to first to fourth inlet ports 31 to 34, and sixth cooling water pipe 76 is connected to outlet port 35.

Flow channel switching valve 30 is, for example, a rotational flow channel switching valve that includes a stator having first to fourth inlet ports 31 to 34 and outlet port 35, and a rotor having flow channels therein and being rotatably fitted in the stator. Flow channel switching valve 30 connects the flow channels of the rotor to the ports of the stator in accordance with the angle of the rotor changed from a reference angle by the electric actuator such as an electric motor. In flow channel switching valve 30, the flow channels of the rotor and the like are formed such that the opening area ratio among first to fourth inlet ports 31 to 34 are changed in accordance with the angle of the rotor. This configuration makes it possible to achieve a desirable opening area ratio among first to fourth inlet ports 31 to 34 by choosing the angle of the rotor.

In the configuration describe above, head cooling water passage 61 and first cooling water pipe 71 are included in a first cooling water line through which the cooling water flows by way of cylinder head 11 and radiator 50. Block cooling water passage 62 and second cooling water pipe 72 are included in a second cooling water line through which the cooling water flows by way of cylinder block 12 while bypassing radiator 50. Head cooling water passage 61 and fourth cooling water pipe 74 are included in a third cooling water line through which the cooling water flows by way of cylinder head 11 and heater core 91 while bypassing radiator 50. Head cooling water passage 61 and third cooling water pipe 73 are included in the fourth cooling water line through which the cooling water flows by way of cylinder head 11 and oil warmer 21 in transmission 20 while bypassing radiator 50. Eighth cooling water pipe 78 is included in a bypass line through which the cooling water partially diverted from first cooling water pipe 71 enters a point near the outlet of flow channel switching valve 30, that is, flows into sixth cooling water pipe 76 after bypassing radiator 50.

In other words, the inlets of flow channel switching valve 30 are connected respectively to the first to fourth cooling water lines, and the outlet of flow channel switching valve 30 is connected to the intake of water pump 40. Thereby, flow rate control valve 30 is capable of controlling the distribution ratio of the cooling water among the first to fourth cooling water lines by regulating the opening areas of the outlets of these cooling water lines.

Figure 2:
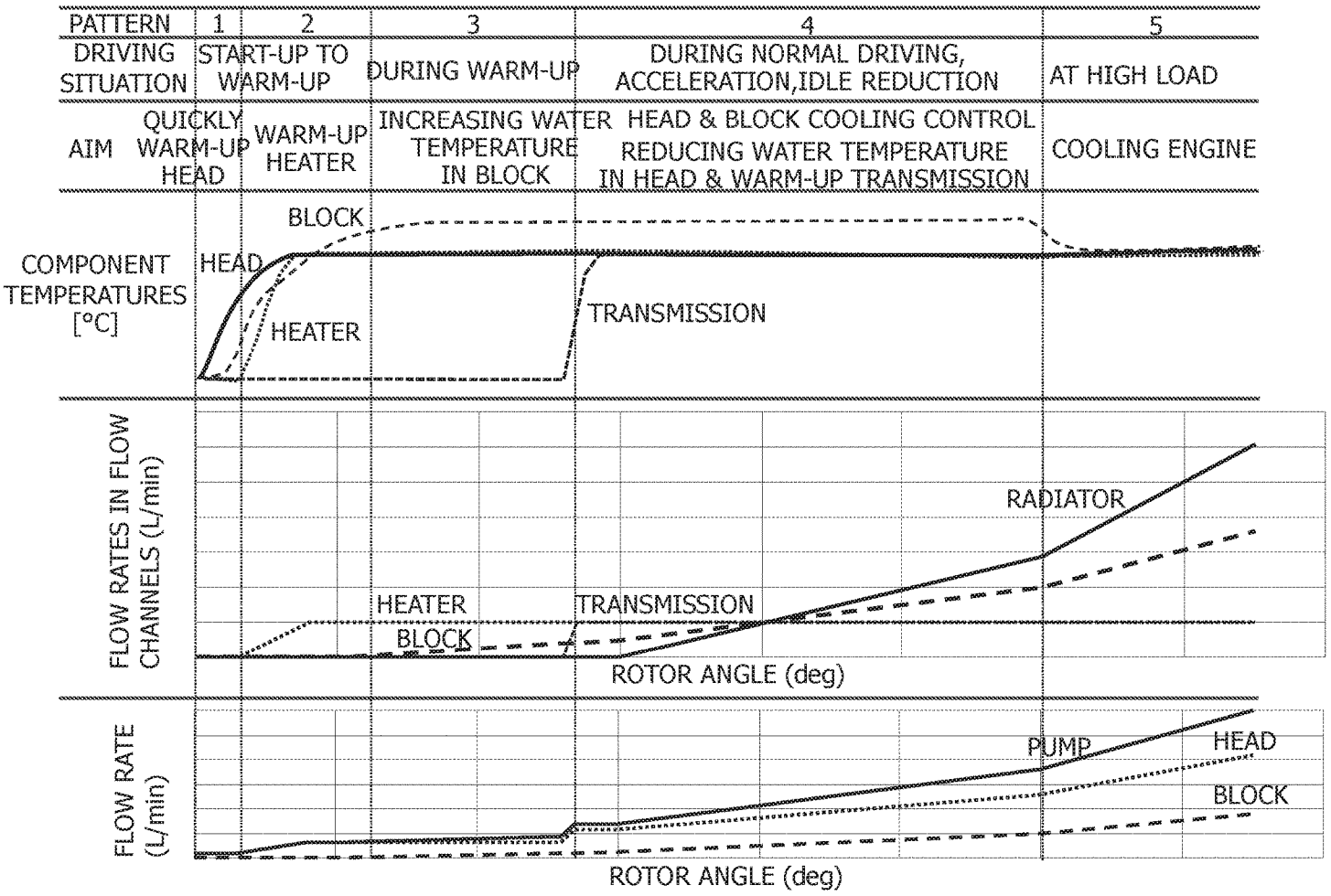
FIG. 2 is a time chart of an example of control patterns of a flow channel switching valve.

Flow channel switching valve 30, which has a plurality of flow channel switching patterns as exemplified in FIG. 2, is switched to any one of the flow channel switching patterns in accordance with the rotor angle changed by the electric actuator after the start-up of internal combustion engine 10.

Figure 3:
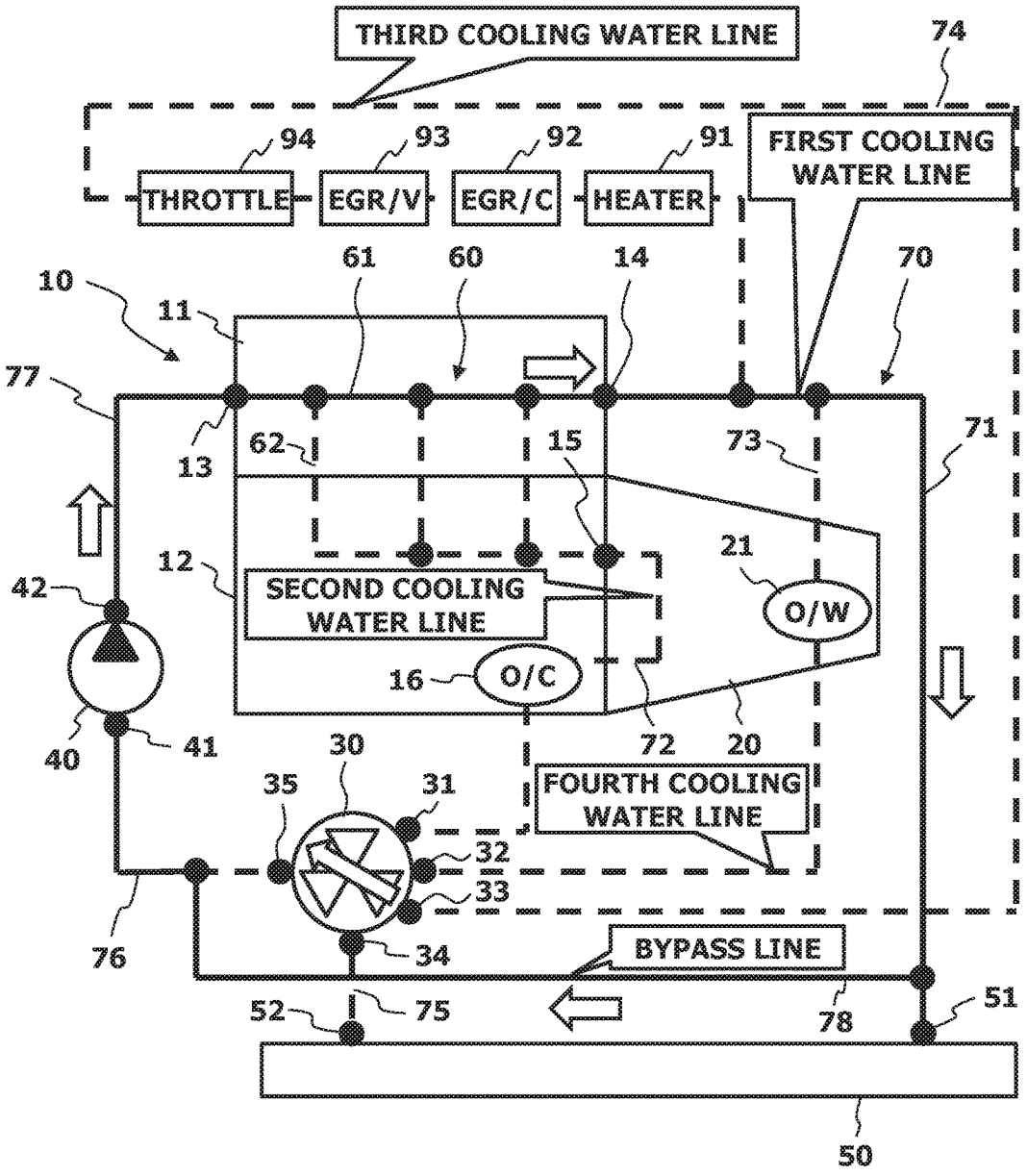
FIG. 3 illustrates an example of a cooling water flow channel in a first pattern.

Specifically, when the rotor angle is within a predetermined angle range from the reference angle at which the rotor is regulated by a stopper, flow channel switching valve 30 is set to a first pattern for closing all first to fourth inlet ports 31 to 34. In the first pattern, second cooling water pipe 72, third cooling water pipe 73, fourth cooling water pipe 74, and fifth cooling water pipe 75 are closed, so that the cooling water discharged from water pump 40 flows through the first cooling water line and the bypass line as illustrated in FIG. 3 so as to cool only cylinder head 11 of internal combustion engine 10. Note that the conditions in which all first to fourth inlet ports 31 to 34 are closed include not only the condition in which the opening area of each of first to fourth inlet ports 31 to 34 is zero, but also the conditions in which the opening area of each of first to fourth inlet ports 31 to 34 is the minimum value greater than zero, that is, the conditions in which the cooling water slightly leaks from first to fourth inlet ports 31 to 34.

Figure 4:
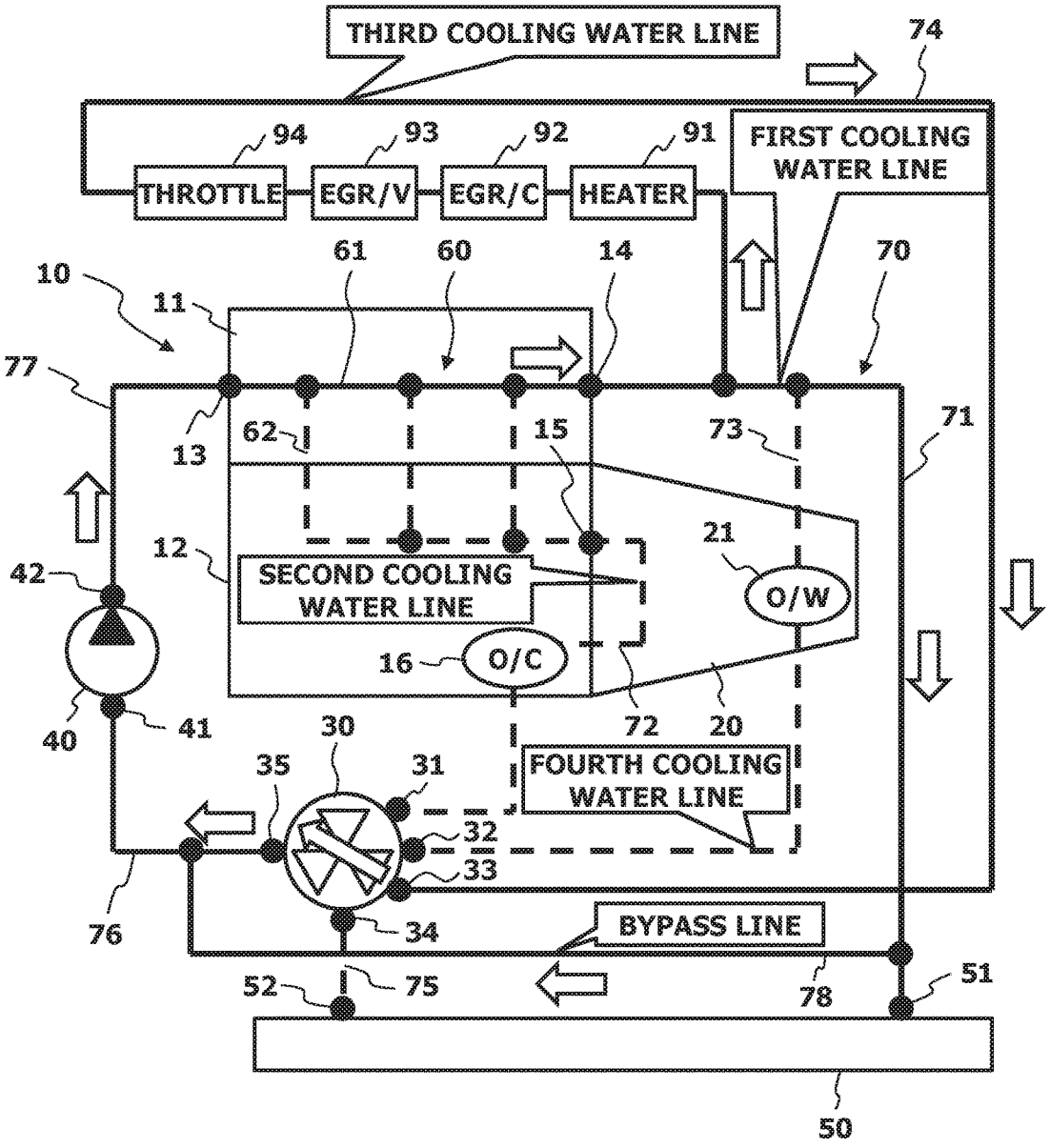
FIG. 4 illustrates an example of a cooling water flow channel in a second pattern.

When the rotor angle of flow channel switching valve 30 is increased to be greater than the angle at which all first to fourth inlet ports 31 to 34 are closed, flow channel switching valve 30 shifts to a second pattern in which third inlet port 33 gradually opens to a predetermined extent, and then the opening area of third inlet port 33 remains fixed at the predetermined value as the rotor angle increases. In the second pattern, fourth cooling water pipe 74 opens, so that the cooling water discharged from water pump 40 flows through the first cooling water line, the bypass line, and the third cooling water line as illustrated in FIG. 4. As a result, the cooling water cools cylinder head 11 of internal combustion engine 10, and causes heater core 91 to provide the air heating function.

Figure 5:
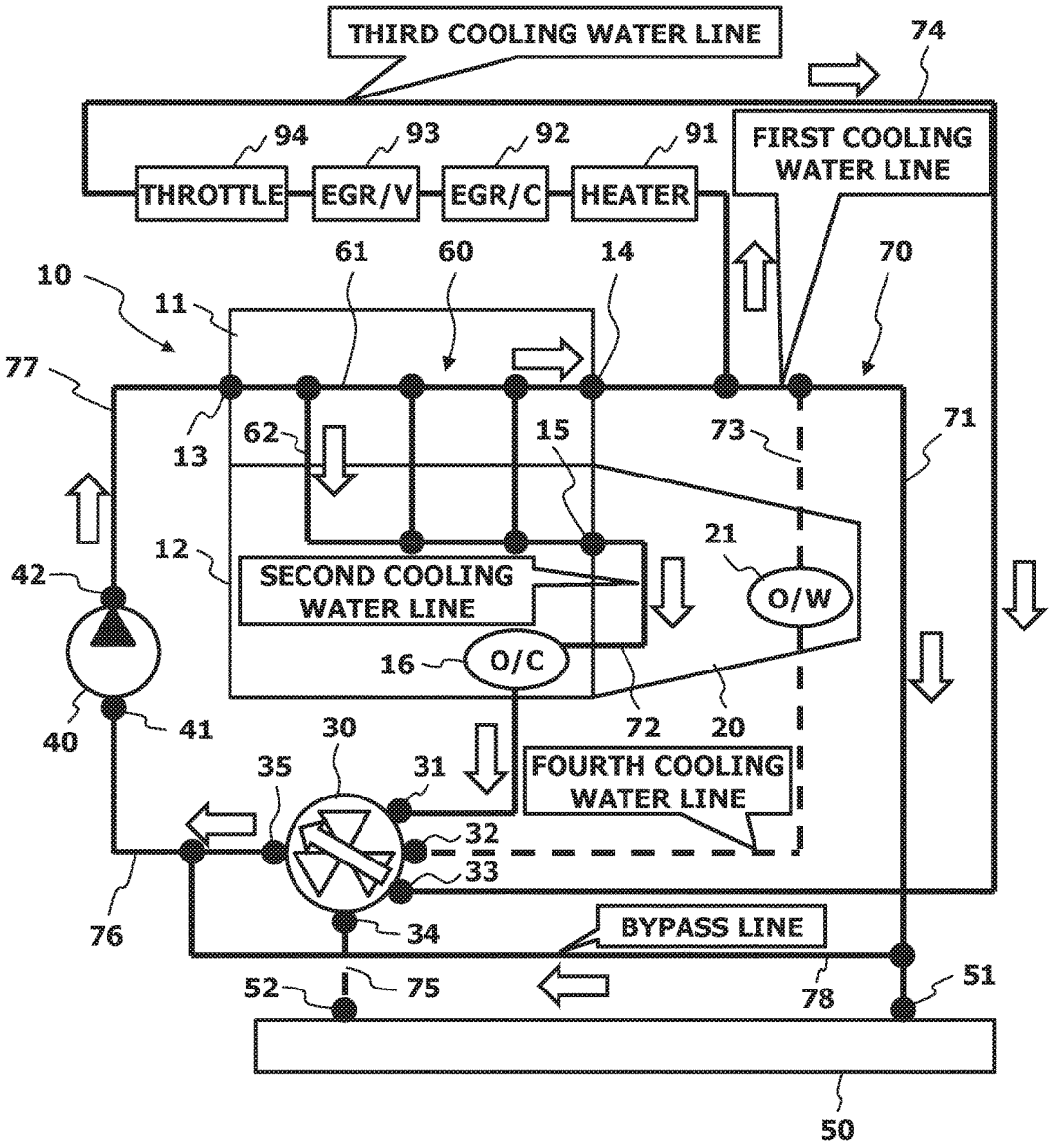
FIG. 5 illustrates an example of a cooling water flow channel in a third pattern.

When the rotor angle of flow channel switching valve 30 increases to be greater than the angle at which the opening area of third inlet port 33 is fixed to the predetermined value, flow channel switching valve 30 shifts to a third pattern in which first inlet port 31 opens in such a manner that the opening area of first inlet port 31 gradually increases along with an increase in the rotor angle. In the third pattern, second cooling water pipe 72 opens, so that the cooling water discharged from water pump 40 flows through the first cooling water line, the bypass line, the second cooling water line, and the third cooling water line as illustrated in FIG. 5. As a result, the cooling water cools cylinder head 11 and cylinder block 12 of internal combustion engine 10, and causes heater core 91 to provide the air heating function.

Figure 6:
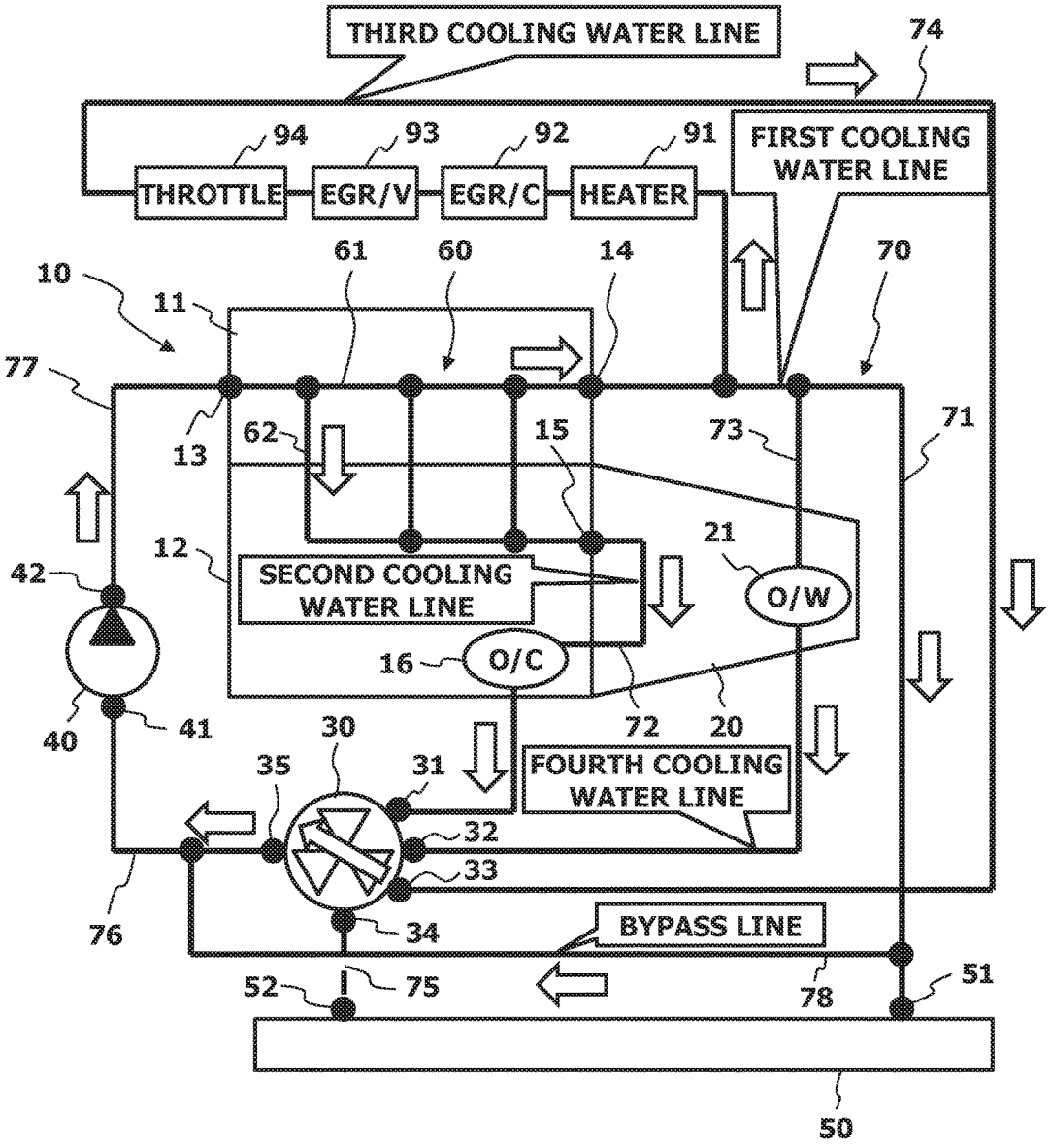
FIG. 6 illustrates an example of a cooling water flow channel in a fourth pattern.

When the rotor angle of flow channel switching valve 30 increases to be greater than the angle at which first inlet port 31 opens, flow channel switching valve 30 shifts to a fourth pattern in which second inlet port 32 gradually opens till its opening area reaches a predetermined value, and then the opening area of second inlet port 32 remains fixed at the predetermined value as the rotor angle increases. In the fourth pattern, third cooling water pipe 73 opens, so that the cooling water discharged from water pump 40 flows through the first cooling water line, the bypass line, the second cooling water line, the third cooling water line, and the fourth cooling water line as illustrated in FIG. 6. As a result, the cooling water cools cylinder head 11 and cylinder block 12 of internal combustion engine 10, causes heater core 91 to provide the air heating function, and heats the lubricant oil for transmission 20.

Figure 7:
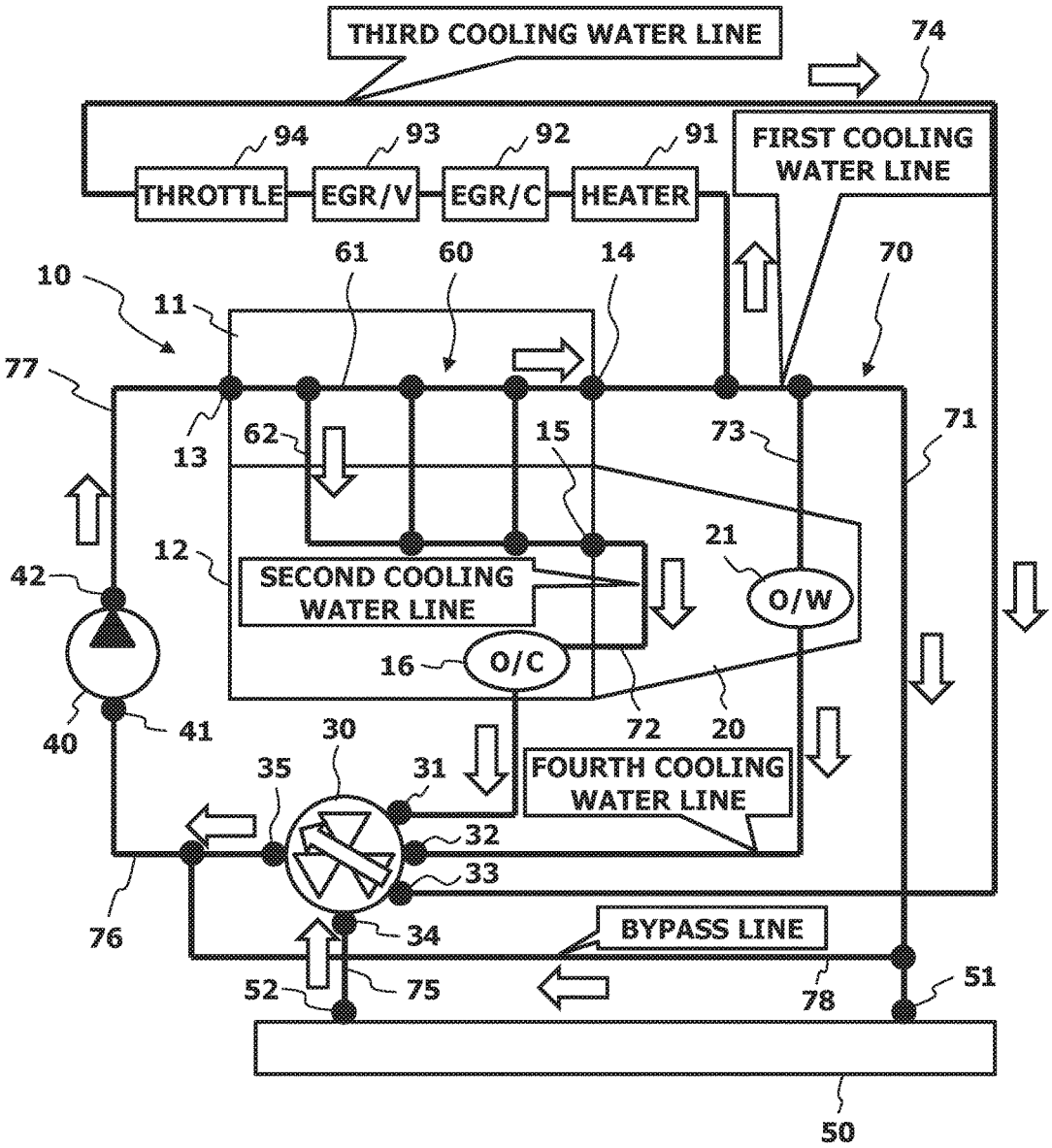
FIG. 7 illustrates an example of a cooling water flow channel in a fifth pattern.

When the rotor angle of flow channel switching valve 30 increases to be greater than the angle at which the opening area of second inlet port 32 is fixed to the predetermined value, flow channel switching valve 30 shifts to a fifth pattern in which fourth inlet port 34 opens in such a manner that the opening area of fourth inlet port 34 gradually increases along with an increase in the rotor angle. In the fifth pattern, fifth cooling water pipe 75 opens, so that the cooling water discharged from water pump 40 flows through the first cooling water line, the second cooling water line, the third cooling water line, the fourth cooling water line, and radiator 50 as illustrated in FIG. 7. As a result, the cooling water cools cylinder head 11 and cylinder block 12 of internal combustion engine 10, causes heater core 91 to provide the air heating function, and heats the lubricant oil for transmission 20. In addition, since the cooling water flows through radiator 50, the cooling water temperature can be maintained at an allowable temperature or less.

In short, flow channel switching valve 30 can switch between the plurality of cooling water passages (the first to fourth cooling water lines and the bypass line) so as to sequentially change at least one cooling water passage to which the cooling water is distributed.

At predetermined points in internal combustion engine 10, there are attached a first temperature sensor 81 for measuring the temperature of cooling water near the outlet of cylinder head 11, and a second temperature sensor 82 for measuring the temperature of cooling water near the outlet of cylinder block 12. In addition, a third temperature sensor 83 for measuring the temperature in the vehicle interior (in-vehicle temperature) is attached to a predetermine point in the vehicle, such as a point near a blow-off outlet for air for air conditioning. A water temperature measurement signal Tw1 from first temperature sensor 81, a water temperature measurement signal Tw2 from second temperature sensor 82, and an in-vehicle temperature measurement signal Tr from third temperature sensor 83 are inputted to electronic control unit 100 which incorporates a processor such as a central processing unit (CPU). The processor in electronic control unit 100 calculates operational variables in accordance with the water temperature measurement signals Tw1 and Tw2 and the in-vehicle temperature measurement signal Tr, and outputs control signals according to the operational variables to flow channel switching valve 30 and water pump 40 so as to electronically control flow channel switching valve 30 and water pump 40.

In addition, electronic control unit 100 also has a function of controlling a fuel injection device 17 and an ignition device 18 in internal combustion engine 10, and an idle stop (idle reduction) function for temporarily stopping internal combustion engine 10 at times such as while the vehicle waits for a traffic light. However, electronic control unit 100 need not perform various controls on internal combustion engine 10. In such case, electronic control unit 100 may interactively communicate with a separate electronic control unit for controlling fuel injection device 17, ignition device 18 and the like in internal combustion engine 10.

Incidentally, while internal combustion engine 10 is in a warm-up operation after the start-up, if flow channel switching valve 30 is switched from the first pattern to the second pattern according to the determination on the warm-up conditions based on the water temperature measurement signal Tw1 from first temperature sensor 81, the following problem might possibly occur. Specifically, in the first pattern just after the start-up of internal combustion engine 10, the cooling water does not flow through fourth cooling water pipe 74 as illustrated in FIG. 3. Thus, the cooling water temperature in the third cooling water line is lower than that in the first cooling water line. When flow channel switching valve 30 is switched from the first pattern to the second pattern under these conditions, the cooling water temperature supplied to internal combustion engine 10 temporarily drops just after the switching since the cooling water having flown through the third cooling water line enters the first cooling water line. Such a drop in temperature of the cooling water supplied to internal combustion engine 10 slows down the warm up of internal combustion engine 10, thus deteriorates fuel economy, exhaust gas properties and the like in internal combustion engine 10. In addition, in such case, the cooling water supplied to heater core 91 also drops. This temporarily decreases the temperature of the air for air conditioning, and thus, for example, might possibly make occupants in the vehicle feel uncomfortable.

To address the above, such a temporal drop in the cooling water temperature upon the switching of flow channel switching valve 30 from the first pattern to the second pattern is curbed by controlling flow channel switching valve 30 and water pump 40 as follows.

First Embodiment

Figure 8:
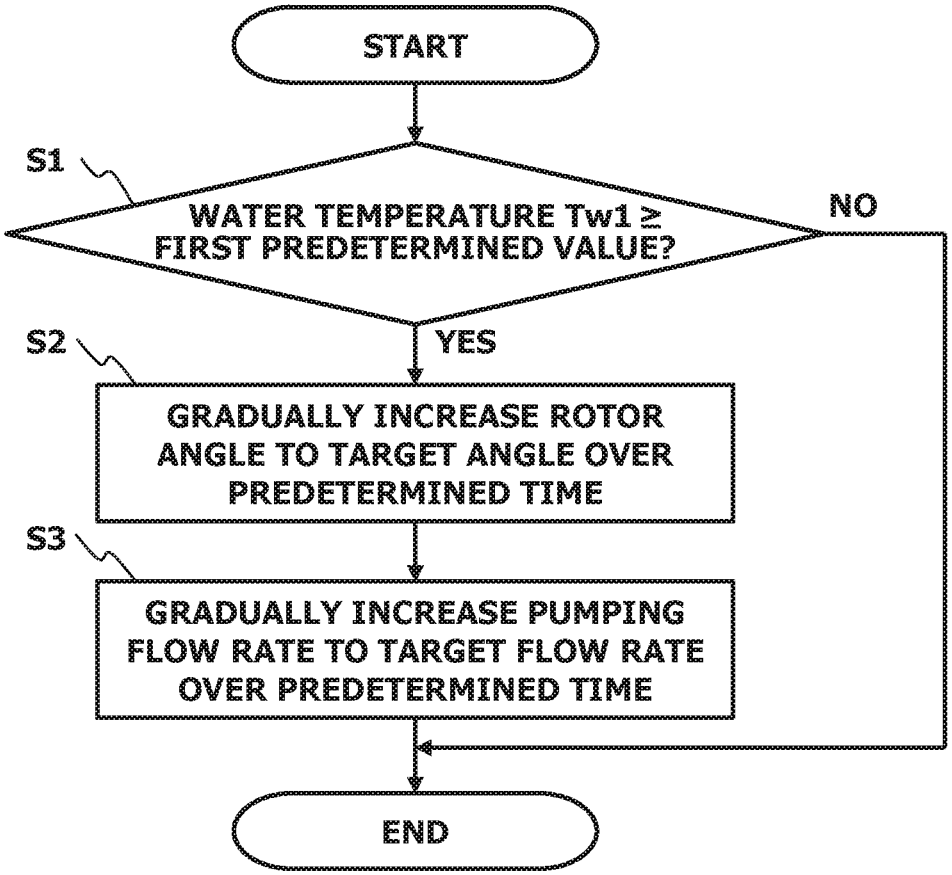
FIG. 8 is a flowchart illustrating control of the cooling system according to a first embodiment.

FIG. 8 illustrates a first embodiment of the control that the processor in electronic control unit 100 repeatedly performs on flow channel switching valve 30 and water pump 40 at predetermined time intervals in response to the start-up of internal combustion engine 10. The processor in electronic control unit 100 electronically controls flow channel switching valve 30 and water pump 40 in accordance with a control program stored in a non-volatile memory such as a flash read only memory (ROM) (the same applies hereinafter).

In step 1 (abbreviated as "S1" in FIG. 8; the same applies hereinafter), the processor in electronic control unit 100 determines whether or not the water temperature measurement signal Tw1 from first temperature sensor 81 is equal to or greater than a first predetermined value. Here, the first predetermined value is a threshold for determining whether to switch flow channel switching valve 30 from the first pattern to the second pattern, and, for example, may be a cooling water temperature (60° C.) high enough to allow heater core 91 to provide the air heating function. When the processor in electronic control unit 100 determines that the water temperature measurement signal Tw1 is equal to or greater than the first predetermined value, the operation proceeds to step 2 (Yes). When the processor in electronic control unit 100 determines that the water temperature measurement signal Tw1 is less than the first predetermined value, the processing ends (No).

In step 2, the processor in electronic control unit 100 gradually increases the rotor angle of flow channel switching valve 30 to a target angle (final target angle for the second pattern) over a predetermined time. Here, the predetermined time may be set, for example, to such a value that, even if the cooling water having flown through the third cooling water line enters the first cooling water line increasingly over the predetermined time as the rotor angle of flow channel switching valve 30 increases, the entering cooling water does not so much affect the cooling water temperature in the first cooling water line, in other words, does not so much affect the temperature of the cooling water supplied to heater core 91.

In step 3, the processor in electronic control unit 100 gradually increases the discharge flow rate of water pump 40 to a target flow rate (final target flow rate for the second pattern) over the predetermined time. In short, the processor in electronic control unit 100 controls the discharge flow rate of water pump 40 in accordance with the distribution rate of the cooling water to the cooling water line to which the distribution of the cooling water is just started.

Figure 9:
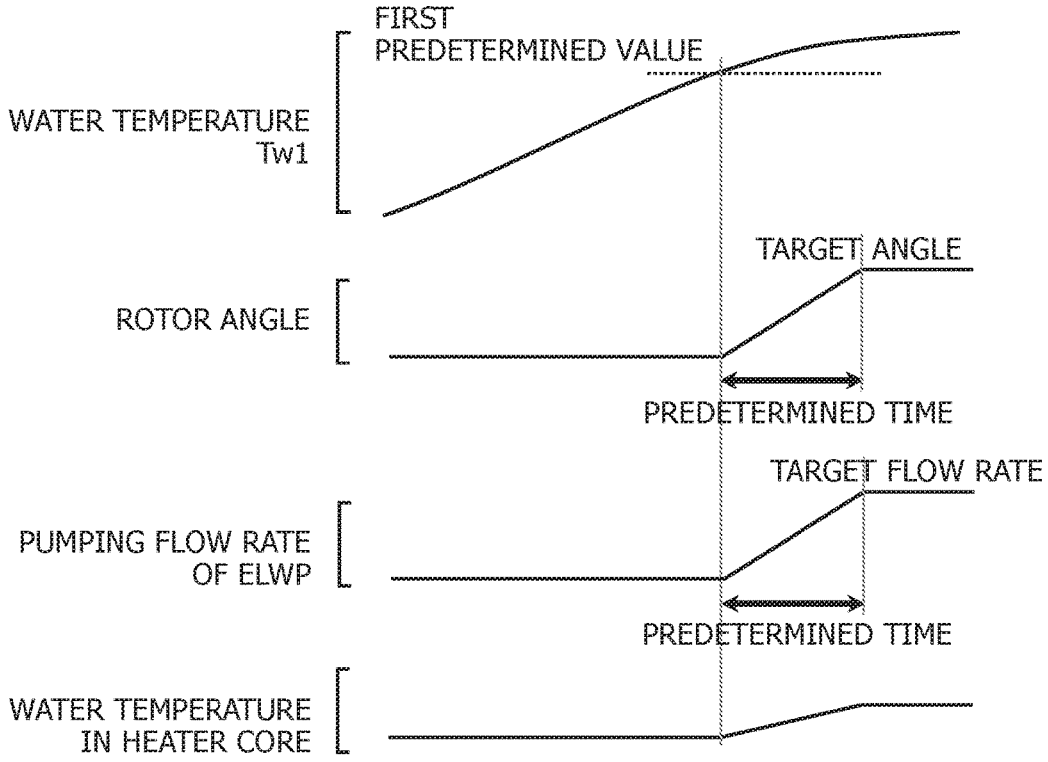
FIG. 9 is a time chart illustrating operational advantages and effects of the first embodiment.

According to the first embodiment, as illustrated in FIG. 9, when the cooling water temperature at the outlet of cylinder block 11 in internal combustion engine 10 increases along with the progress of the warm-up of internal combustion engine 10 to reach the first predetermined value, the rotor angle of low channel switching valve 30 and the discharge flow rate of water pump 40 are gradually increased to their target values over the predetermined time. This suppresses the rate of the cooling water partially diverted from the first cooling water line to the third cooling water line, in other words, suppresses the distribution rate of the cooling water to the third cooling water line.

Accordingly, just after flow channel switching valve 30 is switched from the first pattern to the second pattern, the absolute amount of the cooling water that enters the first cooling water line after flowing through the third cooling water line is reduced. This allows curbing a temporal drop in the cooling water temperature in the first cooling water line. In short, by suppressing the distribution rate of the cooling water to the third cooling water line to which the distribution of the cooling water is just started, a temporal drop in the cooling water temperature can be curbed in the first cooling water line. In this process, the cooling water having flown through the third cooling water line still enters the first cooling water line at some flow rate. However, this does not so much lower the cooling water temperature in the first cooling water line since the cooling water in the first cooling water line is heated by the heat of combustion of internal combustion engine 10.

Second Embodiment

Figure 10:
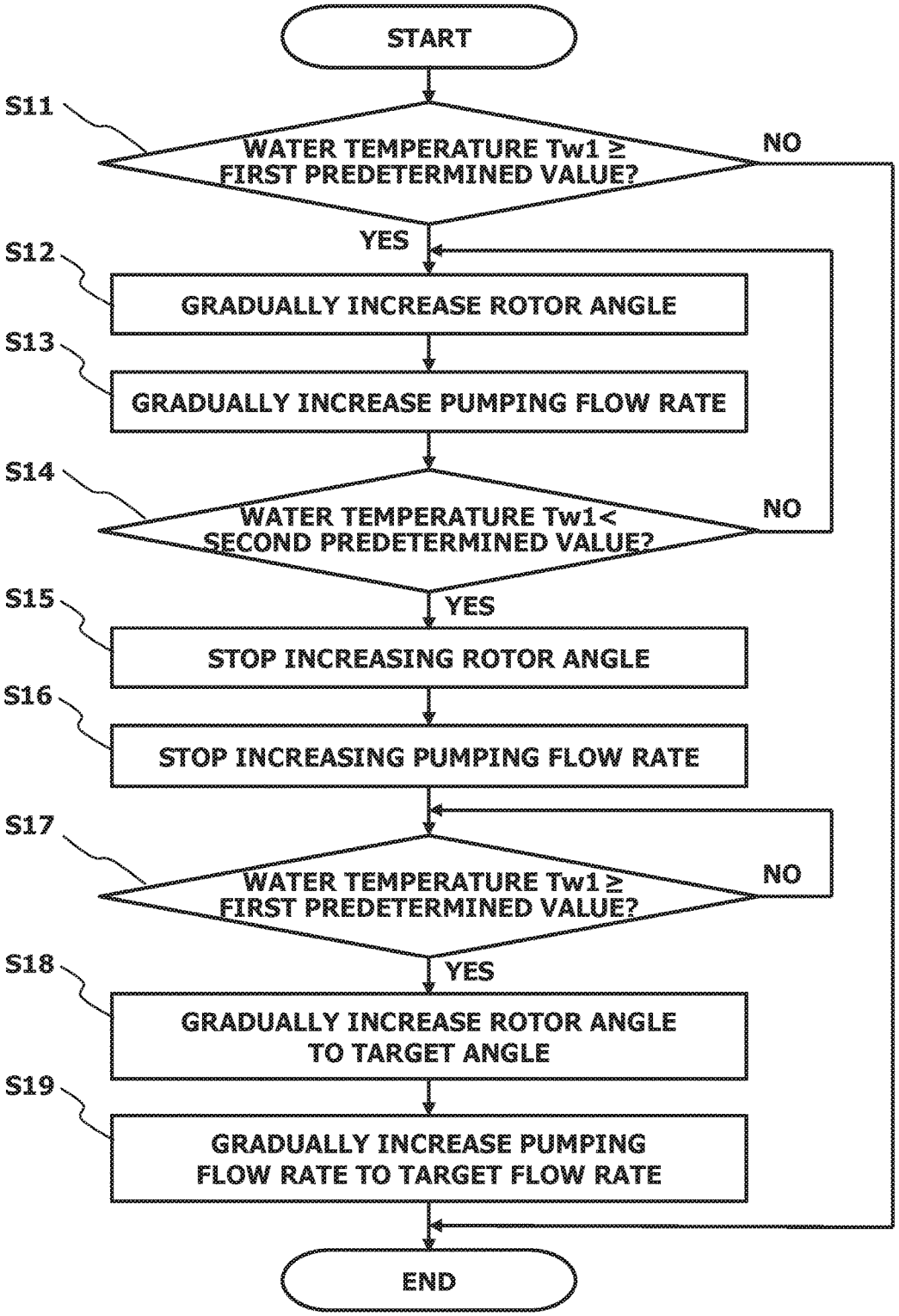
FIG. 10 is a flowchart illustrating control of the cooling system according to a second embodiment.

FIG. 10 illustrates a second embodiment of the control that the processor in electronic control unit 100 repeatedly performs on flow channel switching valve 30 and water pump 40 at predetermined time intervals in response to the start-up of internal combustion engine 10. Note that the same steps of the processing as in the first embodiment will be briefly described so as to eliminate redundant description.

Refer to the description for the first embodiment when necessary (the same applies hereinafter).

In step 11, the processor in electronic control unit 100 determines whether or not the water temperature measurement signal Tw1 from first temperature sensor 81 is equal to or greater than the first predetermined value. When the processor in electronic control unit 100 determines that the water temperature measurement signal Tw1 is equal to or greater than the first predetermined value, the operation proceeds to step 12 (Yes). When the processor in electronic control unit 100 determines that the water temperature measurement signal Tw1 is less than the first predetermined value, the processing ends (No).

In step 12, the processor in electronic control unit 100 gradually increases the rotor angle of flow channel switching valve 30. Here, the increased amount of the rotor angle may be the integral multiple of the minimum angle controllable by the electric actuator, for example.

In step 13, the processor in electronic control unit 100 gradually increases the discharge flow rate of water pump 40. In short, the processor in electronic control unit 100 controls the discharge flow rate of water pump 40 in accordance with the distribution rate of the cooling water to the cooling water line to which the distribution of the cooling water is just started. Here, the increased amount of the discharge flow rate may be the integral multiple of the minimum flow rate controllable by the electric motor, for example.

In step 14, the processor in electronic control unit 100 determines whether or not the water temperature measurement signal Tw1 from first temperature sensor 81 is less than a second predetermined value. Here, the second predetermined value is a threshold for determining whether to temporarily stop increasing the rotor angle of flow channel switching valve 30 and the discharge flow rate of water pump 40, and, for example, may be lower than the first predetermined value by 3 to 5° C. When the processor in electronic control unit 100 determines that the water temperature measurement signal Tw1 is less than the second predetermined value, the operation proceeds to step 15 (Yes). When the processor in electronic control unit 100 determines that the water temperature measurement signal Tw1 is equal to or greater than the second predetermined value, the operation returns to step 12 (No). Note that the second predetermined value is an example of a first predetermined temperature.

In step 15, the processor in electronic control unit 100 stops increasing the rotor angle of flow channel switching valve 30 so as to maintain the current rotor angle.

In step 16, the processor in electronic control unit 100 stops increasing, the discharge flow rate of water pump 40 so as to maintain the current discharge flow rate.

In step 17, the processor in electronic control unit 100 determines whether or not the water temperature measurement signal Tw1 from first temperature sensor 81 is equal to or greater than the first predetermined value. When the processor in electronic control unit 100 determines that the water temperature measurement signal Tw1 is equal to or greater than the first predetermined value, the operation proceeds to step 18 (Yes). When determining that the water temperature measurement signal Tw1 is less than the first predetermined value, the processor in electronic control unit 100 stands by (No).

In step 18, the processor in electronic control unit 100 gradually increases the rotor angle of flow channel switching valve 30 to its target angle. Here, the increase rate of the rotor angle may be set, for example, to a value that does not allow the cooling water temperature in the first cooling water line to abruptly change.

In step 19, the processor in electronic control unit 100 gradually increases the discharge flow rate of water pump 40 to its target flow rate. Here, the increase rate of the discharge flow rate may be set, for example, to a value that does not allow the cooling water temperature in the first cooling water line to abruptly change.

Figure 11:
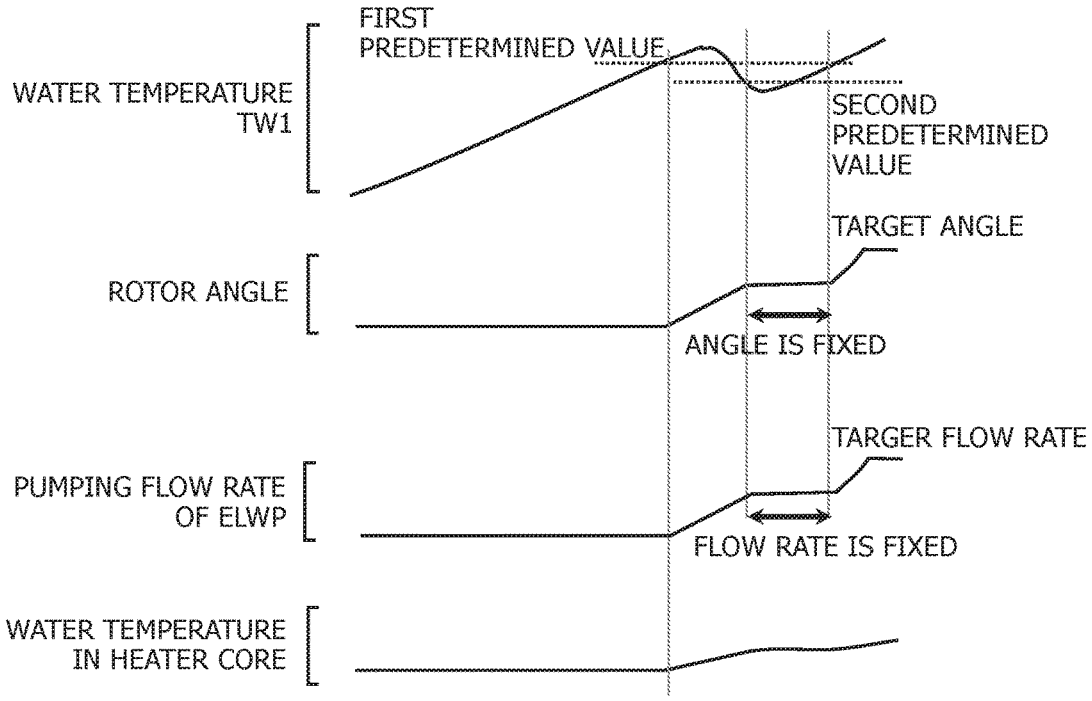
FIG. 11 is a time chart illustrating operational advantages and effects of the second embodiment.

According to the second embodiment, as illustrated in FIG. 11, when the cooling water temperature at the outlet of cylinder block 11 in internal combustion engine 10 increases along with the progress of the warm-up of internal combustion engine 10 to reach the first predetermined value, the rotor angle of low channel switching valve 30 and the discharge flow rate of water pump 40 are gradually increased. When the cooling water temperature in the first cooling water line decreases to the second predetermined value as the cooling water having flown through the third cooling water line enters the first cooling water line increasingly along with an increase in the rotor angle and discharge flow rate, the rotor angle of flow channel switching valve 30 and the discharge flow rate of water pump 40 are stopped from increasing, and thus maintained at the current rotor angle and discharge flow rate. In other words, when the cooling water temperature in the first cooling water line decreases to the second predetermined value during the process of increasing the distribution rate of the cooling water to the third cooling water line, the distribution rate of the cooling water to the third cooling water line is temporarily stopped from increasing. Then, when the cooling water temperature in the first cooling water line increases to the first predetermined value after the cooling water in the first cooling water line is heated by the heat of combustion of internal combustion engine 10, the rotor angle of flow channel switching valve 30 and the discharge flow rate of water pump 40 are increased toward their target values. In short, when the cooling water temperature in the first cooling water line is increased to the first predetermined value by temporarily stopping increasing the distribution rate of the cooling water to the third cooling water line, this temporal stop is canceled.

Accordingly, when the cooling water temperature in the first cooling water line decreases by a predetermined value just after flow channel switching valve 30 is switched from the first pattern to the second pattern, the flow rate of the cooling water partially diverted from the first cooling water line to the third cooling water line is limited. This allows curbing a temporal drop in the cooling water temperature in the first cooling water line. In short, similarly to the first embodiment, by suppressing the distribution rate of the cooling water in the third cooling water line to which the distribution of the cooling water is just started, a temporal drop in the cooling water temperature can be curbed in the first cooling water line.

Third Embodiment

Figure 12:
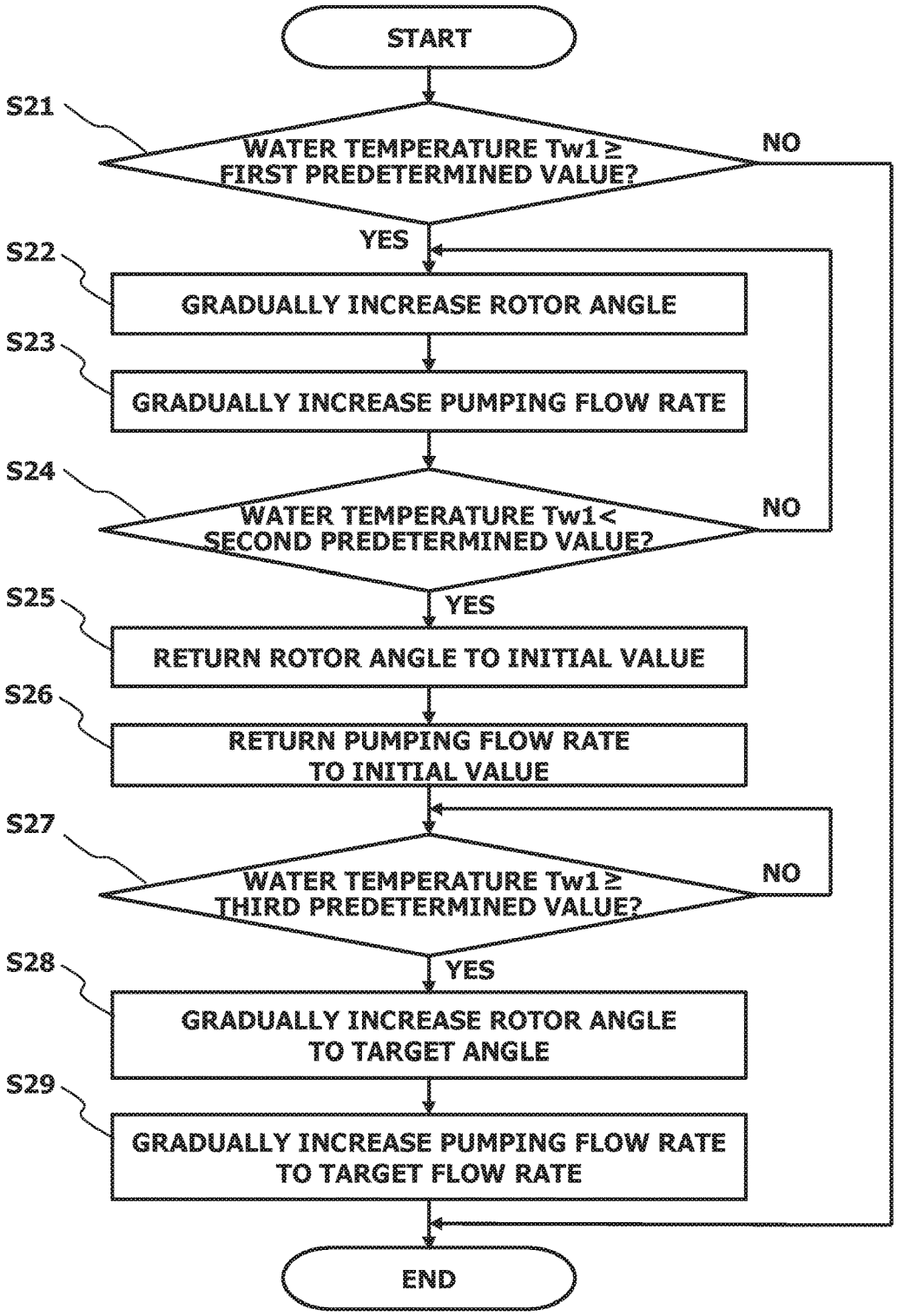
FIG. 12 is a flowchart illustrating control of the cooling system according to a third embodiment.

FIG. 12 illustrates a third embodiment of the control that the processor in electronic control unit 100 repeatedly performs on flow channel switching valve 30 and water pump 40 at predetermined time intervals in response to the start-up of internal combustion engine 10.

In step 21, the processor in electronic control unit 100 determines whether or not the water temperature measurement signal Tw1 from first temperature sensor 81 is equal to or greater than the first predetermined value. When the processor in electronic control unit 100 determines that the water temperature measurement signal Tw1 is equal to or greater than the first predetermined value, the operation proceeds to step 22 (Yes). When the processor in electronic control unit 100 determines that the water temperature measurement signal Tw1 is less than the first predetermined value, the processing ends (No).

In step 22, the processor in electronic control unit 100 gradually increases the rotor angle of flow channel switching valve 30.

In step 23, the processor in electronic control unit 100 gradually increases the discharge flow rate of water pump 40. In short, the processor in electronic control unit 100 controls the discharge flow rate of water pump 40 in accordance with the distribution rate of the cooling water to the cooling water line to which the distribution of the cooling water is just started.

In step 24, the processor in electronic control unit 100 determines whether or not the water temperature measurement signal Tw1 from first temperature sensor 81 is less than the second predetermined value. When the processor in electronic control unit 100 determines that the water temperature measurement signal Tw1 is less than the second predetermined value, the operation proceeds to step 25 (Yes). When the processor in electronic control unit 100 determines that the water temperature measurement signal Tw1 is equal to or greater than the second predetermined value, the operation returns to step 22 (No). Note that the second predetermined value is an example of the first predetermined temperature.

In step 25, the processor in electronic control unit 100 returns the rotor angle of flow channel switching valve 30 to the initial value. Here, the initial value for the rotor angle may be set to the rotor angle (final target angle for the first pattern) at the start of controlling flow channel switching valve 30.

In step 26, the processor in electronic control unit 100 returns the discharge flow rate of water pump 40 to the initial value. Here, the initial value for the discharge flow rate may be set to the discharge flow rate (final target flow rate for the first pattern) at the start of controlling the discharge flow rate of water pump 40.

In step 27, the processor in electronic control unit 100 determines whether or not the water temperature measurement signal Tw1 from the first temperature sensor 81 is equal to or greater than a third predetermined value. Here, the third predetermined value is a threshold for determining whether to restart to increase the rotor angle of flow channel switching valve 30 and the discharge flow rate of water pump 40, and, for example, may be higher than the first predetermined value by approximately 10° C. When the processor in electronic control unit 100 determines that the water temperature measurement signal Tw1 is equal to or greater than the third predetermined value, the operation proceeds to step 28 (Yes). When determining that the water temperature measurement signal Tw1 is less than the third predetermined value, the processor in electronic control unit 100 stands by (No). Note that the third predetermined value is an example of a second predetermined temperature.

In step 28, the processor in electronic control unit 100 gradually increases the rotor angle of flow channel switching valve 30 to its target angle.

In step 29, the processor in electronic control unit 100 gradually increases the discharge flow rate of water pump 40 to its target flow rate.

Figure 13:
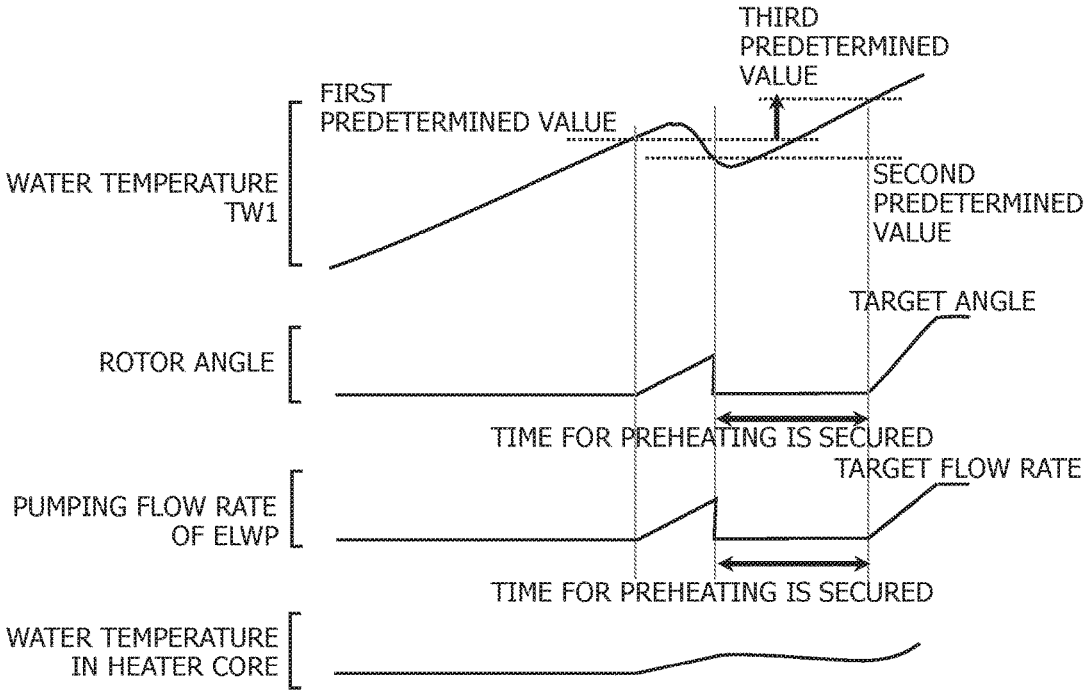
FIG. 13 is a time chart illustrating operational advantages and effects of the third embodiment.

According to the third embodiment, as illustrated in FIG. 13, when the cooling water temperature at the outlet of cylinder block 11 in internal combustion engine 10 increases along with the progress of the warm-up of internal combustion engine 10 to reach the first predetermined value, the rotor angle of low channel switching valve 30 and the discharge rate of water pump 40 are gradually increased. When the cooling water temperature in the first cooling water line decreases to the second predetermined value as the cooling water having flown through the third cooling water line enters the first cooling water line increasingly along with an increase in the rotor angle and discharge flow rate, the rotor angle of flow channel switching valve 30 and the discharge flow rate of water pump 40 are returned to their initial values. In other words, when the cooling water temperature in the first cooling water line decreases to the second predetermined value during the process of increasing the distribution rate of the cooling water to the third cooling water line, the distribution rate is returned to the initial value. Then, when the cooling water temperature in the first cooling water line increases to the third predetermined value, which is higher than the first predetermined value, after the cooling water in the first cooling water line is heated by the heat of combustion of internal combustion engine 10, the rotor angle of flow channel switching valve 30 and the discharge flow rate of water pump 40 are increased from their initial values toward their target values. In short, when the cooling water temperature in the first cooling water line is increased to the third predetermined value by returning the distribution rate to the initial value, the distribution rate of the cooling water to the third cooling water line is restarted to increase.

Accordingly, when the cooling water temperature in the first cooling water line decreases by the predetermined value just after flow channel switching valve 30 is switched from the first pattern to the second pattern, the flow rate of the cooling water partially diverted from the first cooling water line to the third cooling water line is reduced to zero. This allows curbing a temporal drop in the cooling water temperature in the first cooling water line. In short, similarly to the first and second embodiments, by suppressing the distribution rate of the cooling water in the third cooling water line to which the distribution of the cooling water is just started, a temporal drop in the cooling water temperature can be curbed in the first cooling water line. In addition, by setting, to a value higher than the first predetermined value, the third predetermined value at which the rotor angle of flow channel switching valve 30 and the discharge flow rate of water pump 40 is restarted to increase, hunting can be prevented or reduced in flow channel switching valve 30 and water pump 40.

Fourth Embodiment

Figure 14:
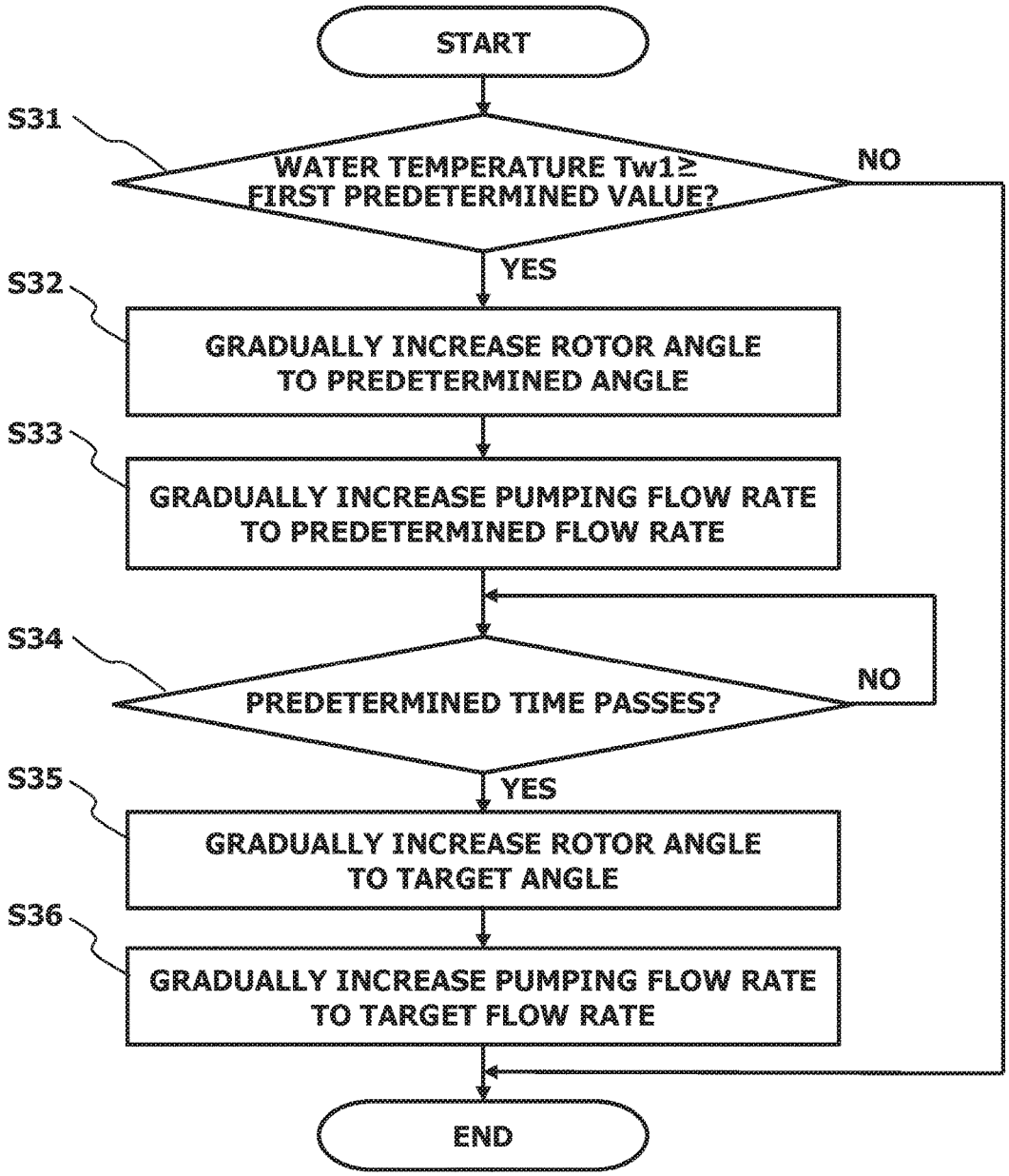
FIG. 14 is a flowchart illustrating control of the cooling system according to a fourth embodiment.

FIG. 14 illustrates a fourth embodiment of the control that the processor in electronic control unit 100 repeatedly performs on flow channel switching valve 30 and water pump 40 at predetermined time intervals in response to the start-up of internal combustion engine 10.

In step 31, the processor in electronic control unit 100 determines whether or not the water temperature measurement signal Tw1 from first temperature sensor 81 is equal to or greater than the first predetermined value. When the processor in electronic control unit 100 determines that the water temperature measurement signal Tw1 is equal to or greater than the first predetermined value, the operation proceeds to step 32 (Yes). When the processor in electronic control unit 100 determines that the water temperature measurement signal Tw1 is less than the first predetermined value, the processing ends (No).

In step 32, the processor in electronic control unit 100 gradually increases the rotor angle of flow channel switching valve 30 to a predetermined angle. Here, the predetermined angle may be set, for example, to an angle that allows preheating of the cooling water in the third cooling water line on which heater core 91 is disposed, that is, allows gradually increasing the cooling water temperature in the third cooling water line before the third cooling water line opens.

In step 33, the processor in electronic control unit 100 gradually increases the discharge flow rate of water pump 40 to a predetermined flow rate. In short, the processor in electronic control unit 100 controls the discharge flow rate of water pump 40 in accordance with the distribution rate of the cooling water to the cooling water line to which the distribution of the cooling water is just started. Here, the predetermined flow rate may be set, for example, to a flow rate that allows preheating of the cooling water in the third cooling water line on which heater core 91 is disposed, that is, allows gradually increasing the cooling water temperature in the third cooling water line before the third cooling water line opens at full level.

In step 34, the processor in electronic control unit 100 determines whether or not a predetermined time has passed since the rotor angle of flow channel switching valve 30 and the discharge flow rate of water pump 40 start to gradually increase. Here, the predetermined time is a threshold for determining whether or not the preheating of the cooling water in the third cooling water line is completed, and, for example, may be set to a value determined in consideration of the cooling water capacity of the third cooling water line. When the processor in electronic control unit 100 determines that the predetermined time has passed, the operation proceeds to step 35 (Yes). When determining that the predetermined time has not passed yet, the processor in electronic control unit 100 stands by (No).

In step 35, the processor in electronic control unit 100 gradually increases the rotor angle of flow channel switching valve 30 to its target angle.

In step 36, the processor in electronic control unit 100 gradually increases the discharge flow rate of water pump 40 to its target flow rate.

Figure 15:
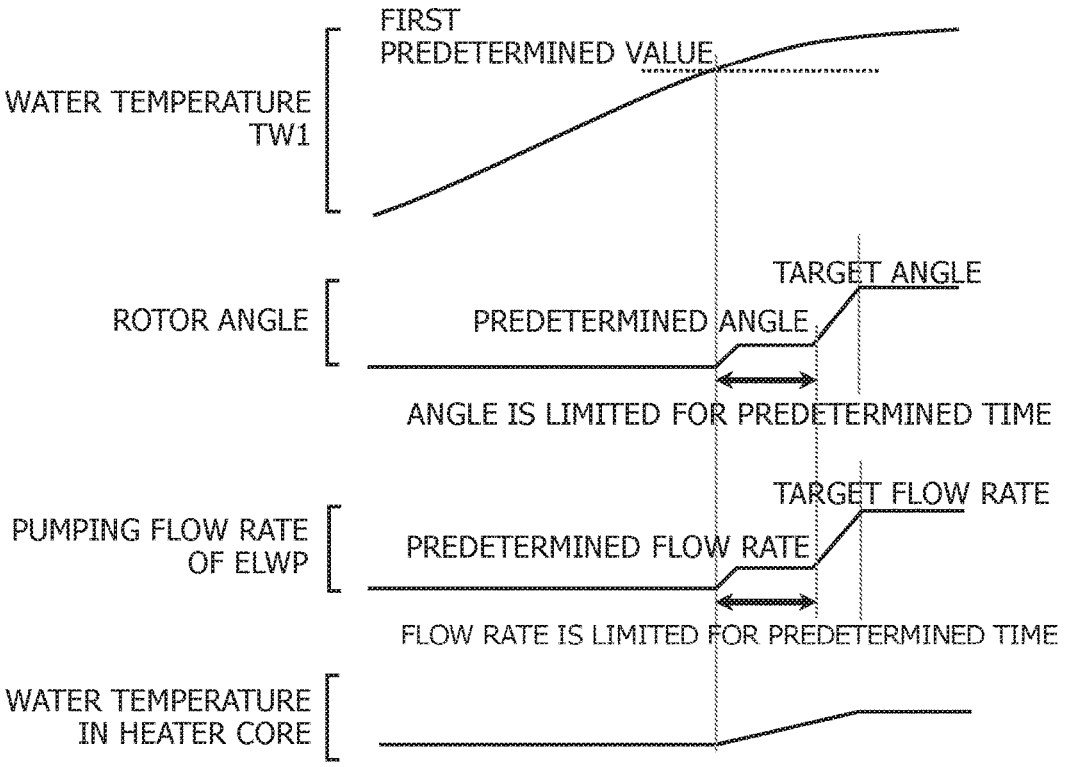
FIG. 15 is a time chart illustrating operational advantages and effects of the fourth embodiment.

According to the fourth embodiment, as illustrated in FIG. 15, when the cooling water temperature at the outlet of cylinder block 11 in internal combustion engine 10 increases along with the progress of the warm-up of internal combustion engine 10 to reach the first predetermined value, the rotor angle of low channel switching valve 30 and the discharge rate of water pump 40 are gradually increased to their predetermined values. After reaching these predetermined values, the rotor angle and the discharge flow rate are limited at the predetermined values for the predetermined time after the rotor angle and discharge flow rate start to increase. In other words, during the process of increasing the distribution rate of the cooling water to the third cooling water line, the distribution rate of the cooling water to the third cooling water line is temporarily stopped from increasing. Accordingly, the cooling water flows through the third cooling water line at a small rate with the rotor angle and the discharge flow rate limited at their predetermined values, so that the cooling water temperature in third cooling water line is gradually increased by the heat of combustion of internal combustion engine 10. In this event, appropriately setting the predetermined values allows increasing the cooling water temperature in the third cooling water line while preventing a temperature drop thereof. Then, when the predetermined time passes, the rotor angle of flow channel switching valve 30 and the discharge flow rate of water pump 40 are gradually increased from their predetermined values to their target values.

Accordingly, just after flow channel switching valve 30 is switched from the first pattern to the second pattern, the cooling water is supplied at a small rate from the first cooling water line to the third cooling water line. Thereby, the cooling water in the third cooling water line can be preheated. Thus, similarly to the first to third embodiments, by suppressing the distribution rate of the cooling water in the third cooling water line to which the distribution of the cooling water is just started, a temporal drop in the cooling water temperature can be curbed in the first cooling water line.

Figure 16:
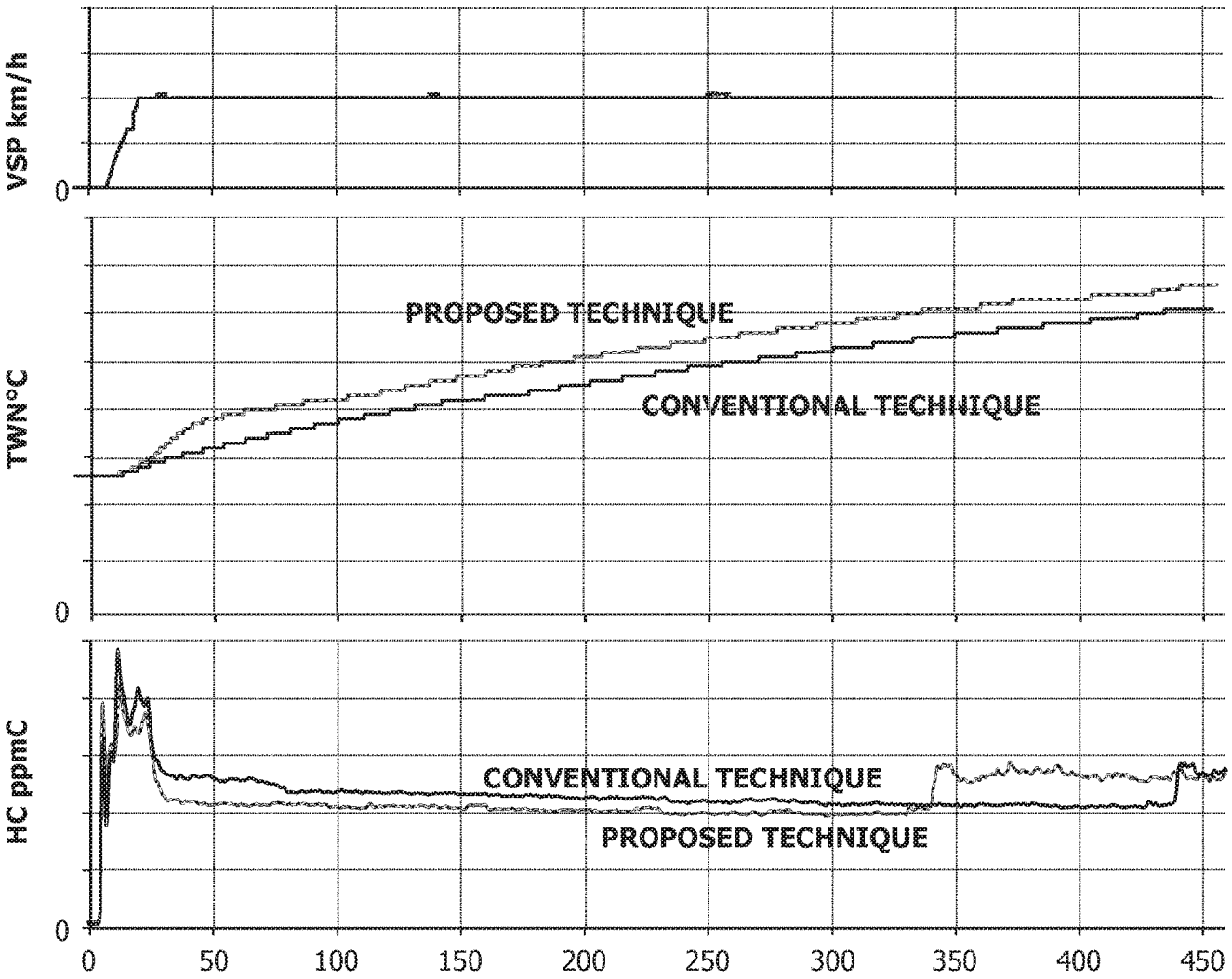
FIG. 16 is a time chart for illustrating effects of the proposed technique.

FIG. 16 illustrates measurements of the vehicle speed, the cooling water temperature, the hydrocarbon emissions in the above-described first to fourth embodiments obtained under predetermined conditions. By referring to the measurements in FIG. 16, it may be understood that the first to fourth embodiments are capable of accelerating the warm-up of internal combustion engine 10 while reducing hydrocarbon emissions by enhancing the combustion performance.

In the third embodiment, when the temperature in the vehicle interior is low, the second predetermined value may be selected in place of the first predetermined value as the threshold for switching flow channel switching valve 30 from the first pattern to the second pattern. This means that the cooling water temperature at which the cooling water starts to be diverted into the third cooling water line is set higher, thus enhancing the air heating performance at the start of air heating.

Figure 17:
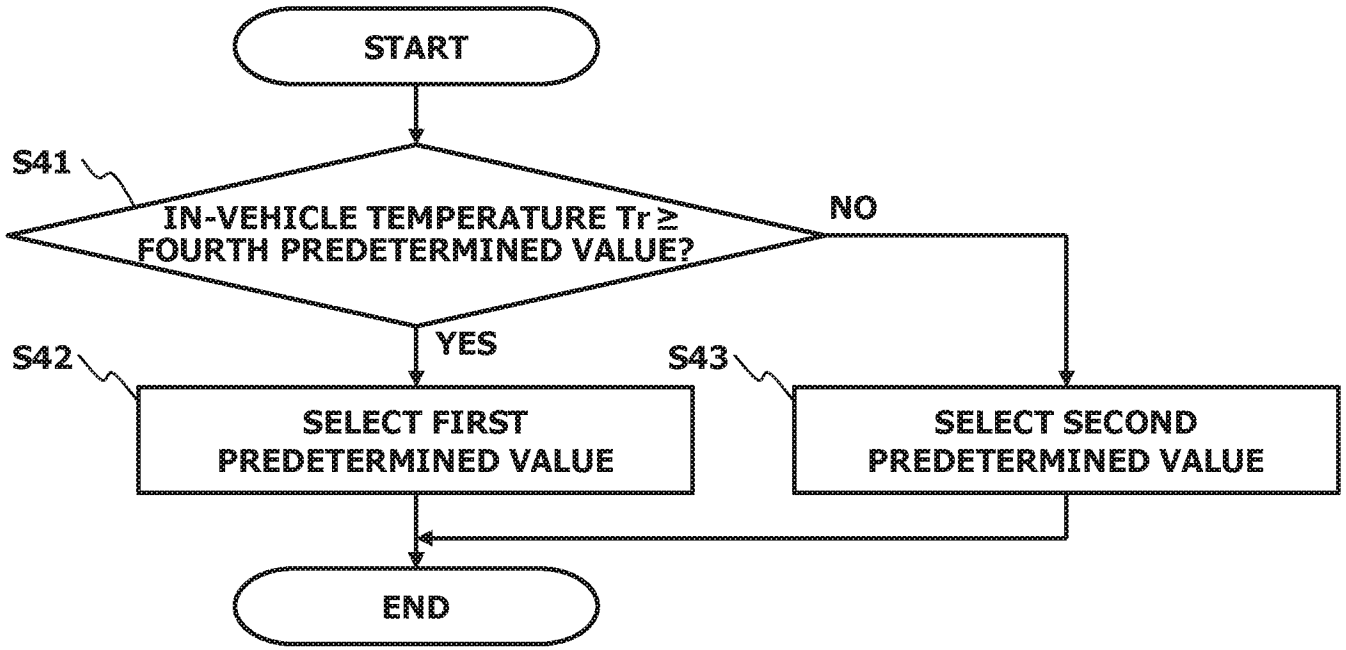
FIG. 17 is a flowchart illustrating control of the cooling system according to a first application example.

FIG. 17 illustrates an example of the control for changing the threshold for switching flow channel switching valve 30 from the first pattern to the second pattern. The control is repeatedly performed by the processor in electronic control unit 100 at predetermined time intervals in response to the start-up of internal combustion engine 10.

In step 41, the processor in electronic control unit 100 determines whether or not the in-vehicle temperature measurement signal Tr from third temperature sensor 83 is equal to or greater than a fourth predetermined value. Here, the fourth predetermined value is a threshold for determining whether or not the temperature in the vehicle interior is low enough to require high air heating performance, and, for example, may be slightly higher than the outside air temperature. When the processor in electronic control unit 100 determines that the in-vehicle temperature measurement signal Tr is equal to or greater than the fourth predetermined value, the operation proceeds to step 42 (Yes). When the processor in electronic control unit 100 determines that the in-vehicle temperature measurement signal Tr is less than the fourth predetermined value, the operation proceeds to step 43 (No).

In step 42, the processor in electronic control unit 100 selects the first predetermined value as the threshold for switching flow channel switching valve 30 from the first pattern to the second pattern.

In step 43, the processor in electronic control unit 100 selects the second predetermined value as the threshold for switching flow channel switching valve 30 from the first pattern to the second pattern.

To achieve the control of the cooling system of internal combustion engine 10 herein, it is sufficient to apply any one of the first to fourth embodiments to the cooling system for internal combustion engine 10. Alternatively, however, the fourth embodiment and any one of the first to third embodiments may be applied to the cooling system for internal combustion engine 10, and the applied two embodiments may be switched from one to another in accordance with the temperature in the vehicle interior. This allows further enhancing the air heating performance at the start of air heating.

Figure 18:
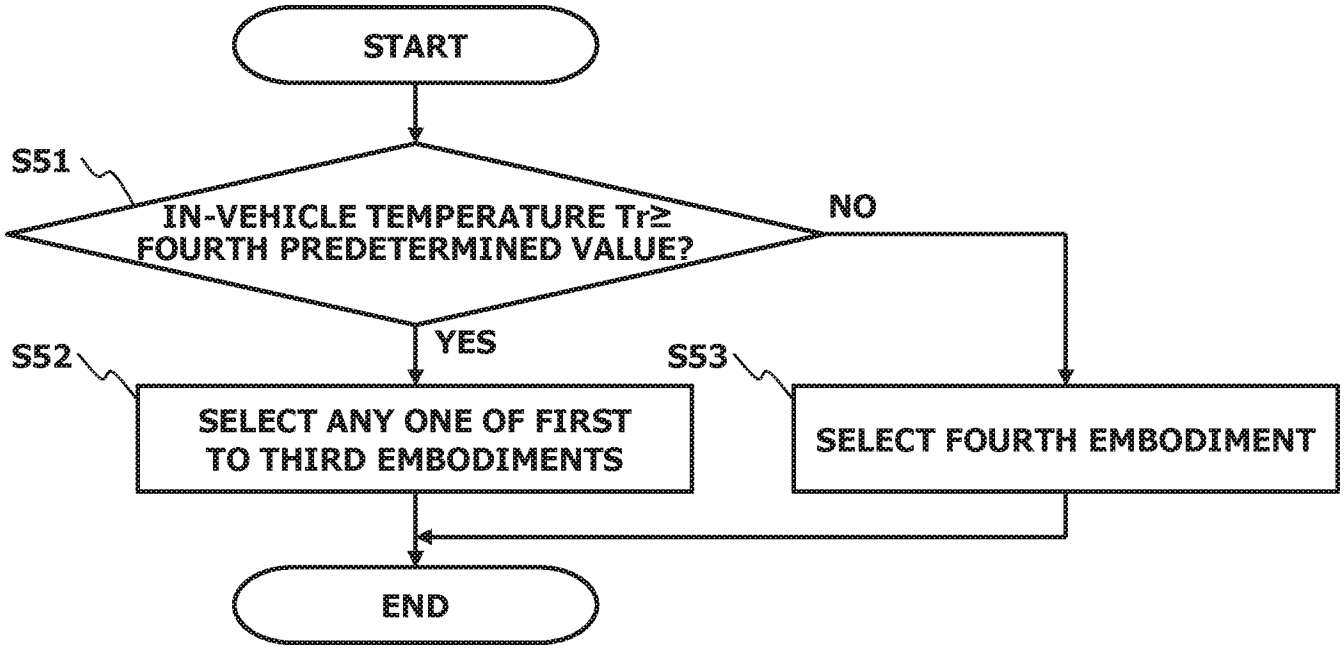
FIG. 18 is a flowchart illustrating control of the cooling system according to a second application example.

FIG. 18 illustrates an example of the control for selecting between the embodiments which is repeatedly performed by the processor in electronic control unit 100 at predetermined time intervals in response to the start-up of internal combustion engine 10.

In step 51, the processor in electronic control unit 100 determines whether or not the in-vehicle temperature measurement signal Tr from third temperature sensor 83 is equal to or greater than the fourth predetermined value. When the processor in electronic control unit 100 determines that the in-vehicle temperature measurement signal Tr is equal to or greater than the fourth predetermined value, the operation proceeds to step 52 (Yes). When the processor in electronic control unit 100 determines that the in-vehicle temperature measurement signal Tr is less than the fourth predetermined value, the operation proceeds to step 53 (No).

In step 52, the processor in electronic control unit 100 selects any one embodiment from the first to third embodiments.

In step 53, the processor in electronic control unit 100 selects the fourth embodiment.

In the embodiments described above, a temporal drop in the cooling water temperature upon switching flow channel switching valve 30 from the first pattern to the second pattern is curbed by controlling flow channel switching valve 30 and water pump 40. Alternatively, however, the same may be achieved by controlling only flow channel switching valve 30.

REFERENCE SYMBOL LIST

10 internal combustion engine
30 flow channel switching valve
40 water pump
60 cooling water passage
61 head cooling water passage
62 block cooling water passage
70 pipe
71 first cooling water pipe
72 second cooling water pipe
73 third cooling water pipe
74 fourth cooling water pipe
75 fifth cooling water pipe
76 sixth cooling water pipe
77 seventh cooling water pipe
81 first temperature sensor
91 heater core
100 electronic control unit

The invention claimed is:

1. A control device for a cooling system of an internal combustion engine, the control device comprising a processor which controls a flow channel switching valve for switching between a plurality of cooling water passages so as to sequentially change at least one cooling water passage to which cooling water is distributed in accordance with progress of warm-up of the internal combustion engine, wherein the processor is configured to, when switching between the cooling water passages, gradually increase, over a predetermined time to a target value, a distribution rate of the cooling water to the cooling water passage to which the distribution of the cooling water is just started, and temporarily stop increasing the distribution rate of the cooling water to the cooling water passage during process of gradually increasing the distribution rate of the cooling water to the cooling water passage.

2. The control device for the cooling system according to claim 1, wherein the processor is configured to, when switching between the cooling water passages, control a discharge flow rate of an electric water pump for supplying the cooling water to the at least one cooling water passage in accordance with the distribution rate of the cooling water to the cooling water passage to which the distribution of the cooling water is just started.

3. The control device for the cooling system according to claim 1, wherein the processor is configured to temporarily stop increasing the distribution rate of the cooling water to the cooling water passage to which the distribution of the cooling water is just started, when a temperature of the cooling water in the at least one cooling water passage decreases to a first predetermined temperature which is lower than a temperature at which the cooling water passages are switched therebetween.

4. The control device for the cooling system according to claim 3, wherein the processor is configured to cancel temporarily stopping increasing the distribution rate of the cooling water to the cooling water passage to which the distribution of the cooling water is just started, when the temperature of the cooling water in the at least one cooling water passage increases to the temperature at which the cooling water passages are switched therebetween as a result of the stop.

5. The control device for the cooling system according to claim 1, wherein the processor is configured to return, to an initial value, the distribution rate of the cooling water to the cooling water passage to which the distribution of the cooling water is just started, when a temperature of the cooling water in the at least one cooling water passage decreases to a first predetermined temperature which is lower than a temperature at which the cooling water passages are switched therebetween, during process of gradually increasing the distribution rate of the cooling water to the cooling water passage to which the distribution of the cooling water is just started.

6. The control device for the cooling system according to claim 5, wherein the processor is configured to restart to increase the distribution rate of the cooling water to the cooling water passage to which the distribution of the cooling water is just started, when the temperature of the cooling water in the at least one cooling water passage increases to a second predetermined temperature which is higher than the temperature at which the cooling water passages are switched therebetween, as a result of returning, to the initial value, the distribution rate of the cooling water to the cooling water passage to which the distribution of the cooling water is just started.

7. The control device for the cooling system according to claim 1, wherein a heater core of an air heating device is disposed on the cooling water passage to which the cooling water is distributed at the gradually increased distribution rate.

8. A control method for a cooling system of an internal combustion engine wherein a control device controls a flow channel switching valve for switching between a plurality of cooling water passages so as to sequentially change at least one cooling water passage to which cooling water is distributed in accordance with progress of warm-up of the internal combustion engine, and, when switching between the cooling water passages, the control device gradually increases, over a predetermined time to a target value, a distribution rate of the cooling water to the cooling water passage to which the distribution of the cooling water is just started, and temporarily stops increasing the distribution rate of the cooling water to the cooling water passage during process of gradually increasing the distribution rate of the cooling water to the cooling water passage.

9. The control method for the cooling system according to claim 8, wherein, when switching between the cooling water passages, the control device controls a discharge flow rate of an electric water pump for supplying the cooling water to the at least one cooling water passage in accordance with the distribution rate of the cooling water to the cooling water passage to which the distribution of the cooling water is just started.

* * * * *